US005218341A

United States Patent [19]

Marik

[11] Patent Number: 5,218,341

[45] Date of Patent: Jun. 8, 1993

[54] DOOR LOCK REINFORCER AND ALARM DEVICE

[76] Inventor: Victor Marik, 15422 Empanada, Houston, Tex. 77083

[21] Appl. No.: 817,323

[22] Filed: Jan. 6, 1992

[51] Int. Cl.[5] ..... G08B 13/08

[52] U.S. Cl. ..... 340/546; 292/339; 340/566

[58] Field of Search ..... 340/546, 545, 566; 292/339, 338

[56] References Cited

U.S. PATENT DOCUMENTS

| | | | |
|---|---|---|---|
| 4,300,796 | 11/1981 | Lane | 292/339 |
| 4,358,758 | 11/1982 | Morton | 340/546 |
| 4,442,427 | 4/1984 | Morton | 340/546 |
| 4,483,558 | 11/1984 | Van Meter | 292/339 |
| 4,563,027 | 1/1986 | Chechovsky | 292/339 |
| 4,607,253 | 8/1986 | Wooten et al. | 340/546 |
| 4,883,297 | 11/1989 | Smith | 292/339 |
| 4,971,374 | 11/1990 | Lovell et al. | 292/339 |

FOREIGN PATENT DOCUMENTS

| | | | |
|---|---|---|---|
| 3627409 | 2/1988 | Fed. Rep. of Germany | 340/546 |

*Primary Examiner*—Glenn R. Swann, III

*Attorney, Agent, or Firm*—Harrison & Egbert

[57] ABSTRACT

A door looking device has an adjustable length shaft portion of an arcuate shape, a non-skid end portion mounted on a lower end of the shaft portion, and a door handle engaging bracket affixed to an end of the shaft portion opposite the end portion. The bracket has a generally U-shaped configuration. The shaft has an adjustable slide member formed therein. The slide member is affixed to the end portion and is movable so as to move the end portion relative to the shaft portion. The non-skid shaft portion is a pivot pad rotatably connected to the shaft portion. The pivot pad is of generally trapezoidal cross-section. The bracket has a prong formed interior of the configuration and extending upwardly from the shaft portion. An alarm device is mounted on the shaft portion and is responsive to shocks affecting the door handle above a threshold value.

16 Claims, 3 Drawing Sheets

DOOR LOCK REINFORCER AND ALARM DEVICE

TECHNICAL FIELD

The present invention relates to door securing devices. More particularly, the present invention relates to door securing devices of the bracing type. The present invention further relates to door locking devices having alarms attached thereto.

BACKGROUND ART

With the rise in violent crimes in the United States, there is a widespread fear among the people related to their sense of security in the home and perhaps, even more important, when travelling. People staying in hotels and motels often find themselves staying in a room protected only by an inexpensive lock. Many devices have been developed to provide a greater degree of protection by providing some type of portable supplemental locing device. These devices generally fall into three main types: the portable door lock that operates with a key, as a second lock in the door; an alarm device that does not impede the operation of the door, but sounds an alarm when disturbed, and the door brace type that is mounted between the door and the floor, which then acts as a brace.

Prior art security braces for blocking entry through doorways are known. Such devices have not been widely adopted commercially for one of two reasons. The prior art devices which work effectively have been too complex and costly to be practical on the commercial market. Those devices in the prior art which are relatively simple and feasible from a cost standpoint have proven not to operate efficiently with consistency, and therefore have not been acceptable in the marketplace.

A number of patents have issued in the past which deal with door bracing devices. For example, U.S. Pat. No. 4,300,796, issued on Nov. 17, 1981, to J. L. Lane provides an adjustable door and window security prop. In this device, adjustable large and small diameter tubular members are telescopically engaged with each other. A U-shaped member is attached to one of these legs so as to engage a door handle. A stop is provided at the bottom portion of the member for frictional engagement with the floor. A lock structure is provided so as to cause fixed engagement between the tubular members.

U.S. Pat. No. 4,358,758, issued on Nov. 9, 1982, and U.S. Pat. No. 4,442,427, issued on Apr. 10, 1984, both to David C. Morton describe a combination door lock and alarm which has an upper end clip engagable with the door handle, a shaft extending in an adjustable length tube and terminating with a non-skid rubber button adapted to frictionally engage the floor. An alarm device is mounted on the shaft and includes an actuator with a switch contact normally abutting a surface of the door at a point below the door handle. The alarm sounds upon inward movement and pressure on the door. U.S. Pat. No. 4,483,558, issued on Nov. 20, 1984, to V. Van Meter shows a door security device having an elongated rod member of telescoping rod sections, a reversible foot member pivotally connected to the lower end of the rod member, and an abutment member for engaging the surface of the door beneath the door knob. An annular head is pivotally connected to the upper end of the rod member for engaging the shaft of the door knob.

U.S. Pat. No. 4,563,027, issued on Jan. 7, 1986, to Chechovsky et al. provides a door security brace which carries a pivotted foot piece at its lower end having a friction facing to prevent slippage while in contact with the floor. The brace bar carries a pivotted yoke on a pivot axis which is parallel to the foot piece pivot axis. The yoke engages the door knob shank.

U.S. Pat. No. 4,607,253, issued on Aug. 19, 1986, to Wooten et al., provides a combination door lock and alarm having an adjustable shaft, two pivot pads, and an automatic alarm. The pivot feature of the pads is designed for quick set-up of the device. The alarm utilizes a spring clip in contact with a toggle switch. The toggle switch allows for a continuous alarm signal. The alarm is actuated by a spring-loaded shaft which is pushed into the main shaft of the device as pressure is applied to the door. The spring clip is mounted on the outside of the spring-loaded shaft and the movement of this shaft is what forces the clip to trip the toggle switch.

U.S. Pat. No. 4,883,297, issued on Nov. 28, 1989, to D.R. Smith provides a power operated door guard in which an electric motor is utilized so as to cause the parts of the brace to telescope and engage the door knob and the floor.

It is an object of the present invention to provide a door locking device, with shock sensor alarm that is simple to install, easy to manufacture, and relatively inexpensive.

It is another object of the present invention to provide a door locking device which properly distributes bracing forces so as to maximize strength and protection against unauthorized entry.

It is another object of the present invention to provide a door locking device that maximizes surface friction against a floor.

It is still another object of the present invention to provide a door locking device having an alarm which is actuated by vibration.

These and other objects and advantages of the present invention will become apparent from a reading of the attached specification and appended claims.

SUMMARY OF THE INVENTION

The present invention is a door locking device with alarm for portable use and ready installation on a door handle which comprises an adjustable length shaft portion having an arcuate shape, a non-skid end portion mounted on a lower end of the shaft portion, and a door handle engaging bracket affixed to an end of the shaft portion opposite the end portion. The bracket has a generally U-shaped configuration. The shaft portion receives an adjustable slide member therein. The slide member is affixed to the end portion. The slide member is movable so as to move the end portion relative to the shaft portion. A pin engages the shaft portion so as to fix the end portion in position relative to the shaft portion. The slide member includes a plurality of holes arranged longitudinally thereon and positioned in suitable manner so as to be engaged by the pin. The shaft portion has an indicator formed on an outer surface of the shaft portion generally adjacent an outermost point on the arcuate shape. This indicator is indicative of the proper position in which to kick the device in position adjacent to the door.

The non-skid end portion includes a pivot pad which is rotatably connected to the shaft portion. This pivot pad has a flat bottom surface. The pivot pad has a generally trapezoidal cross-section. A wide end of the trapezoidal cross-section is adjacent to the flat bottom surface The bracket has a prong formed on the interior of the U-shaped configuration. This prong extends upwardly from the shaft portion and has a height which is less than the height of the bracket. Both the bracket and the prong are coated with a rubberized material.

The present invention also includes an alarm device which is mounted on the shaft portion. This alarm device is responsive to shocks above a given threshold which affect the door handle or door itself. The alarm produces an audio output in response to shocks above this threshold value. A sensitivity control is included with the alarm device for setting the alarm to the desired threshold of shock.

DETAILED DESCRIPTION OF THE INVENTION

Figure 1:
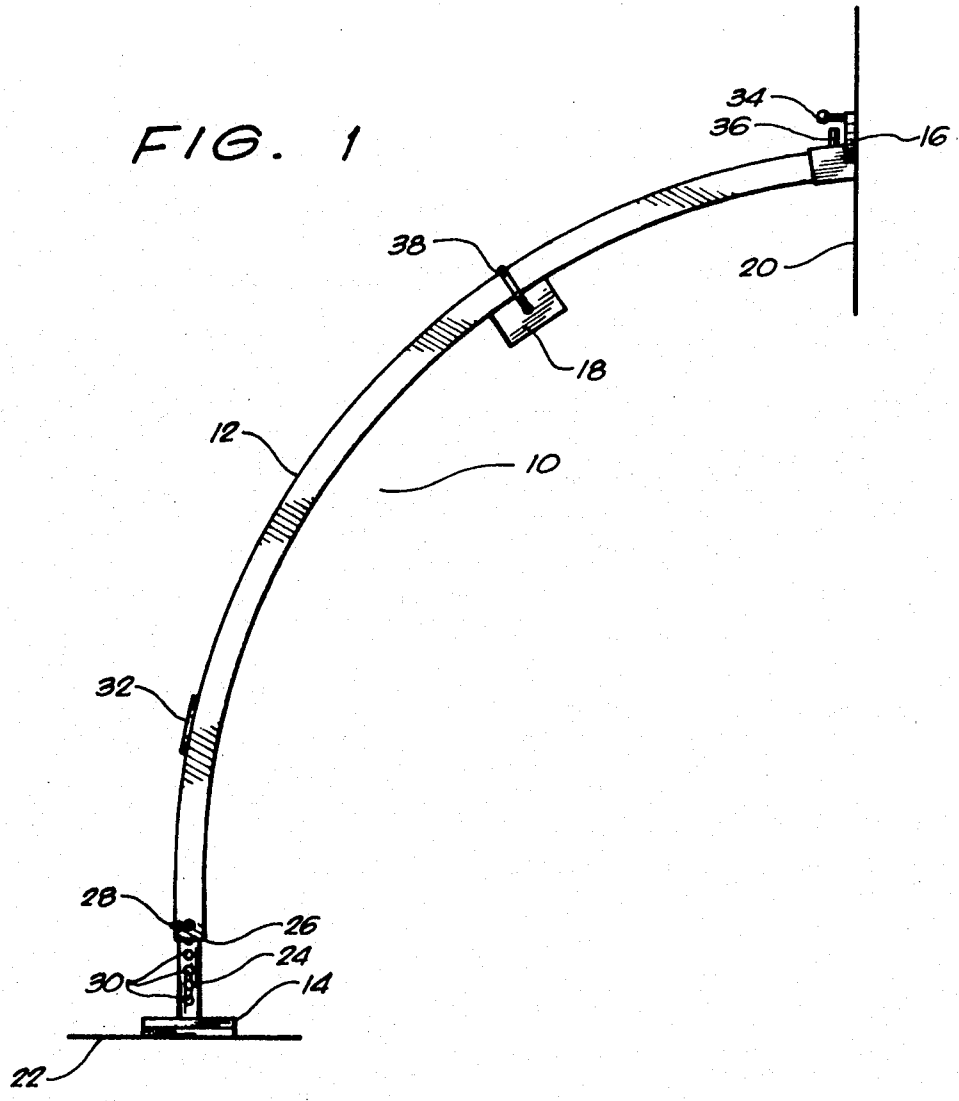
FIG. 1 is a side elevational view of the door locking device in accordance with the preferred embodiment of the present invention.

Referring to FIG. 1, there is shown at 10 the door locking device in accordance with the preferred embodiment of the present invention. Door locking device 10 includes a shaft portion 12, a non-skid end portion 14, a door handle engaging bracket 16, and an alarm device 18. It can be seen that the door locking device 10 is shown as juxtaposed against door surface 20 and floor 22.

The shaft 12 is an adjustable length shaft having an arcute shape. In experiments with the present invention, it was found that the arcuate shape of the shaft 12 causes a greater amount of pressure to be distributed to the end portion 14 juxtaposed against floor 22. This allows the door locking device 10 to provide greater resistance to the opening of the door 20. As can be seen, the shaft portion 12 has an adjustable slide member 24 slidably engaging the shaft 12 at the bottom end 26 of shaft 12. The slide member 24, in general, telescopically engages the shaft 12. The slide member 24 is affixed to the end portion 14. In general, the slide member 24 is movable so as to move the end portion 14 relative to the shaft portion 12. A pin 28 engages the shaft 12 and one of the holes 30. The holes 30 are formed on the slide member 24 and arranged longitudinally thereon. In this manner, the slide member 24 can telescope relative to the shaft portion 12. When the desired length is achieved, the pin 28 engages one of the holes 30 so as to fix the end portion 14 in a proper position. An indicator surface 32 is provided on an outer surface of the shaft portion 12 at an outermost point of the arcuate shape. The indicator 32 can be a pad, a marker, a printing, or other type of emblem to indicate the proper position for kicking the shaft 12 so as to properly engage the shaft in juxtaposition between the floor 22 and the door 20. This allows the user of the door locking device 10 to more properly fit the device in its optimal door securing position.

As can be seen, the bracket 16 has a surface for fitting in flat juxtaposition against the door 20 The bracket 16 also includes a portion which engages the door handle 34. As can be seen, the door handle 34 extends through an opening in the U-shaped configuration of bracket 16. A prong 36 is provided in a suitable position for abutment with the shaft of the door knob 34.

It can further be seen that the alarm device 18 is a box which is fastened to the exterior of shaft 12. Shaft 12 is comprised of square steel tubing. The alarm device 18 includes a strap 38 which engages the exterior of shaft 12 so as to fix the alarm device 18 in a proper position. A more detailed description of the alarm device 18 is provided hereinafter.

Figure 2:
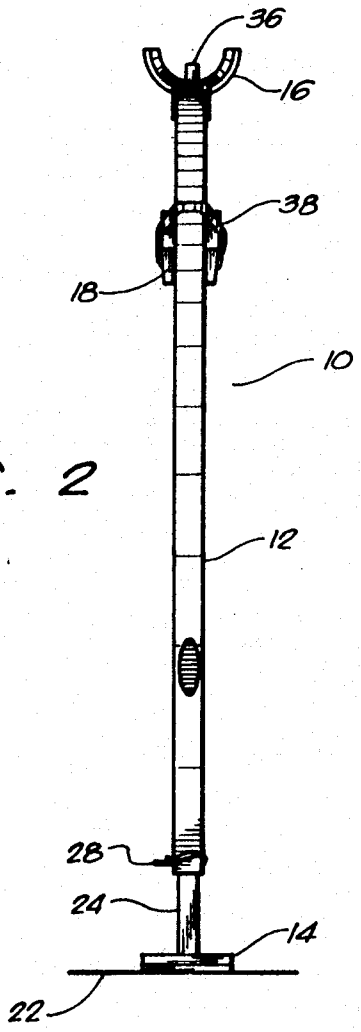
FIG. 2 is an end view of the door locking device of the present invention.

FIG. 2 provides an end view showing the configuration of the door locking device 10. In particular, it can be seen that the shaft 12 telescopically engages the slide member 24. It can further be seen that the pin 28 is suitably retained so as to engage one of the holes in the slide member 24 so as to position the end portion 14 a proper distance from the shaft 12. The configuration of the telescoping slide member 24 allows the door locking device 10 to be adaptable to a wide ranging array of door sizes, shapes, and configurations. The alarm device 18 is strapped around the exterior of shaft 12 generally adjacent to the door engaging bracket 16.

In FIG. 2, it can be seen that the door-engaging bracket 16 has a generally U-shaped configuration. Prong 36 extends upwardly and centrally within this U-shaped configuration. In general, the U-shaped configuration will abut the surface of the door and extend around the door knob frame. In general, the door knob frame is of a circular configuration and is positioned generally beneath the door knob shaft. The prong 36 fits underneath the shaft of the knob. Ideally, the prong will gently touch the bottom of the knob shaft. The U-shaped configuration should touch the door surface after the prong 36 attaches to the knob shaft. This configuration further provides the unexpected benefit of force distribution. As such, the device creates an extra strong force for preventing intrusion through the door. Abutment forces are distributed between the U-shaped configuration and the prong 36. Both the U-shaped configuration 16 and the prong 36 are coated with a rubberized material. The rubberized material will prevent any marring of the finish of the door knob or the door knob frame.

Figure 3:
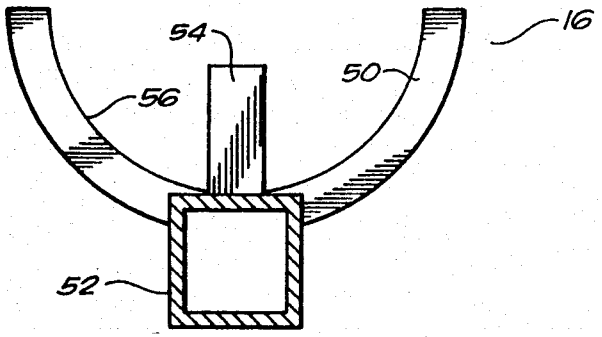
FIG. 3 is an isolated end view showing the door handle engaging bracket of the door locking device of the present invention.

FIG. 3 is an isolated view showing the bracket 16. Initially, it can be seen that the U-shaped head 50 has a generally semi-circular configuration. The head 50 is made of a strong steel material so as to properly engage the door. The head 50 has a suitable thickness for strong abutment against the door to which it is placed. The head 50 is affixed by welding, or other means, to the square steel tubing 52 of the shaft 16. The prong 54 generally extends upwardly from the top surface of the shaft 52 and/or from the inner surface 56 of the head 50. It can be seen that the prong 54 extends upwardly from the top surface of the square tubing 52. The prong 54 generally has a height which is equal to or less than the height of the head 50. The sizing of this arrangement is important so as to adequately resist any forces created by the opening of a door.

Figure 4:
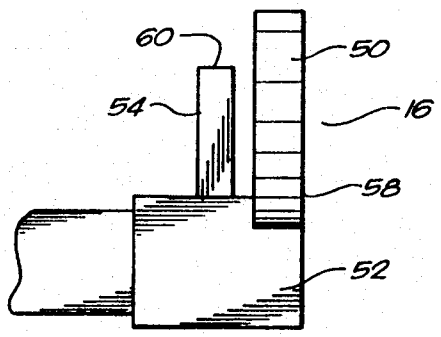
FIG. 4 is an isolated side view of the door handle engaging bracket of the present invention.

FIG. 4 is a side view of the bracket 16 showing that the head 50 is positioned on the far end of the shaft 52. A substantially linear surface 58 is provided between the head 50 and the shaft 52 so as to provide a flat abutment surface for the door. The prong 54 is also attached to the shaft 52 but is positioned behind the location of the head 50. A suitable distance should be provided between the head 50 and the prong 54 so as to accommodate the standard arrangement of door knobs. The top surface 60 of prong 54 will be in general abutment with the door knob shaft.

Figure 5:
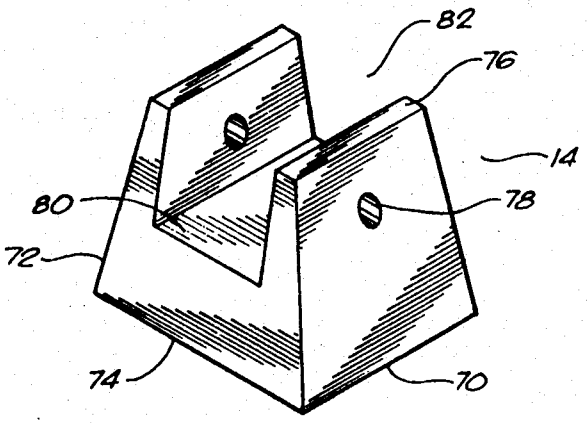
FIG. 5 is a perspective view of the pivot pad of the present invention.

FIG. 5 is a perspective view of the non-skid end portion. As can be seen, the end portion 14 is a pivot pad 70 which can be fastened to the end of the slide member 24 or, alternatively, can be fastened to the bottom end of shaft 12. The pivot pad has a generally trapezoidal configuration. It can be seen that the wide end 72 is adjacent to the flat bottom surface 74. The upper surface 76 includes an aperture 78 for engaging the bottom end of the shaft. The end of the shaft will rest in close abutment to the bottom 80 of interior opening 82. Interior opening 82 will receive the end of the shaft 12.

The configuration of the trapezoidal pivot pad 70 is a preferred arrangement over prior art configurations. Most importantly, the trapezoidal configuration allows a wide bottom surface 74 for maximal frictional engagement with a floor surface. The tapering of the side walls of the pivot pad 70 allows the pivot pad to properly engage the end of the shaft 12.

Figure 6:
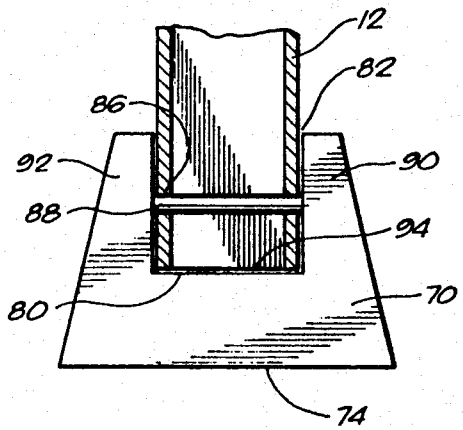
FIG. 6 is a cross-sectional view showing the pivot pad as fastened to the shaft of the present invention.

FIG. 6 shows the manner in which the pivot pad 70 engages the shaft 12 or slide member 24. Importantly, shaft 12 includes an opening 86 therein which receives axle 88. Axle 88 extends through the walls 90 and 92 of pivot pad 70. The axle 88 allows the shaft 12 to be fastened to the pivot pad 70 in rotatable relationship therewith and provide support for the shaft 12. The flat bottom surface 74 is defined by the angling of the walls of sides 90 and 92. The bottom surface 74 will be in frictional engagement with a floor surface. It can further be seen that the shaft 12 has an end 94 which is in close abutting relationship with the inner surface 80 of opening 82. As such, additional structural support is provided to the position of the shaft 12 within the pivot pad 70.

In use, the rotatable pivot pad 70 allows the present invention to be adjusted for various sizes of doors. The pivot pad 70 can be adjusted by bringing it closer to the door or pulling it farther away from the door. Without the pivot pad, techniques would have to be relied upon which would cause the door locking device to be placed too close or too far from the door for adequate structural strength. The use of the pivot pad 70 can be used in combination with the adjustable slide member 24, or can be used directly with the shaft 12. Ideally, the pivot pad 70 has suitable structural integrity to withstand any forces that can be placed upon the door locking device 10.

Figure 7:
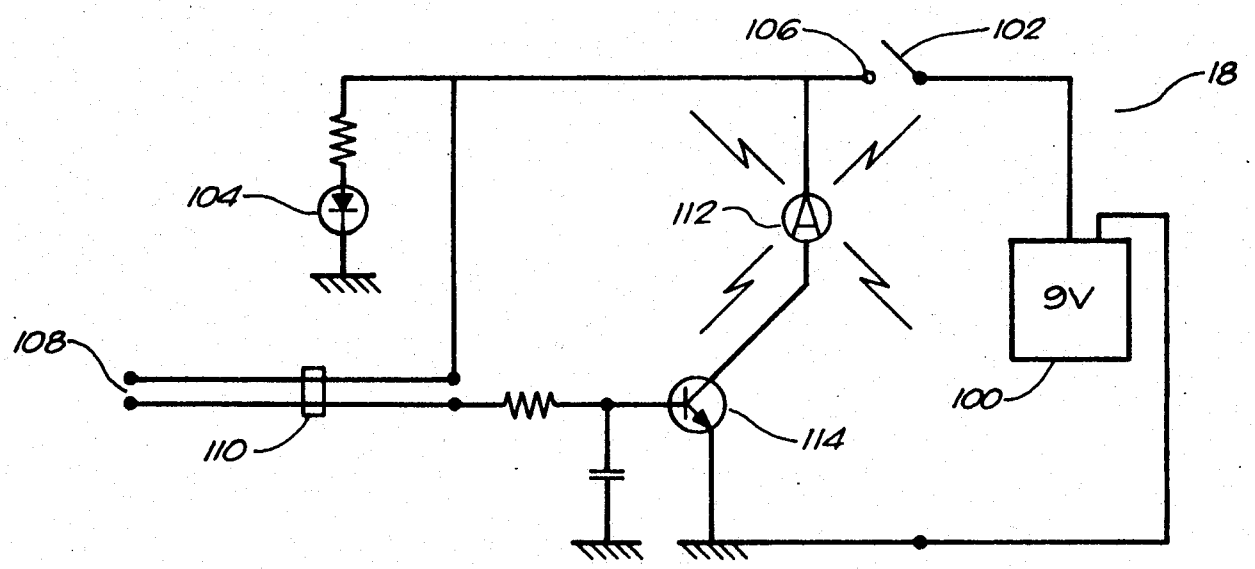
FIG. 7 is an electrical schematic showing the operation of the alarm device of the present invention.

An important feature of the present invention is the use of the alarm device 18. Prior art alarm devices which have been used with such braces have relied upon contact with the door or have required that the door actually be opened before the alarm sounds. In general, if the door must actually be opened before the alarm is sounded, then it is too late for the person within a room to properly prepare for the intrusion. It is inherently more desirable that an alarm be provided which is responsive to the early stages of intrusion, rather than the actual intrusion. If the alarm sounds while manipulations are being made to the door knob or door, then an audio alarm may be capable of scaring the would-be intruder from entering the room. Importantly, however, the alarm device should be of a certain sensitivity so as to prevent accidental actuations. The schematic in FIG. 7 shows such a configuration which can be used for the alarm device 18 of the present invention. In keeping with the present invention, various modifications to the schematic illustration of FIG. 7 can be used. It can initially be seen that the alarm device 18 is powered by a nine-volt battery 100. A switch 102 is provided on the box of alarm 18. The switch 102 is for the manual actuation of the alarm device. After the door locking device 10 of the present invention is positioned in abutment with a door, the switch 102 can be properly actuated so that the alarm device will be responsive to potential intrusion. An LED 104 is included so as to provide a visual indication of the activation of the device. The LED 104 will only be illuminated when the switch 102 goes into contact with contact point 106.

A sensitivity control 108 is provided with the present invention. Sensitivity control 108 includes a pair of contact points which are placed in close proximity. An adjustment mechanism 110 is provided so as to offer a manual means of controlling the distance between the contact points 108. With suitable vibration on the door knob, the contact points 108 will vibrate into contact and thus sound the alarm 112. If the vibration on the door knob does not exceed a threshold level, then the contact points 108 will not engage and the alarm 112 will not sound. Various other aspects of sensitivity control could be incorporated within the sensitivity control mechanism 110. A transistor 114 is provided so as to control the alarm 112 and to provide for the proper logic of the alarm device 18. In addition to the configuration of the schematics illustrated in FIG. 7, various other devices could be incorporated into the alarm device 18. For example, a visual indication, such as a flashing light, could be provided in combination with, or in place of, the audio alarm 112. Suitable volume controls can be included for use in combination with alarm 112. Additionally, various remote devices could also be interconnected with the alarm device 18.

The present invention offers a large number of benefits over prior art bracing devices. The arcuate shape of the shaft provides for a better distribution of forces between the door knob and the floor. The configuration of the door handle engaging bracket further distributes the forces so as to prevent intrusion. The non-skid pivot pad is ideal for adjusting the device for various heights of door knobs. Additionally, the alarm device is vibration sensitive, rather than intrusion sensitive, so as to provide an immediate alarm to the occupant of a room of the initial stages of door manipulation. The present invention is configured in a relatively simple package which is easy to manufacture, simple to use, and relatively inexpensive.

The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

I claim:

1. A door locking device for portable use and ready installation on a door handle comprising:

an adjustable length shaft portion having an arcuate shape throughout;

a non-skid end portion mounted on a lower end of said shaft portion; and a door handle engaging bracket affixed to an end of said shaft portion opposite said end portion, said bracket having a generally U-shaped configuration.

2. The device of claim 1, said shaft portion receiving an adjustable slide member therein, said slide member affixed to said end portion, said slide member movable so as to move said end portion relative to said shaft portion.

3. The device of claim 2, further comprising:

a pin engaging said shaft portion and one of a plurality of holes formed on said slide member, said holes arranged longitudinally along said slide member.

4. The device of claim 1, said shaft portion having an indicator formed on an outer surface of said shaft portion at an outermost point on said arcuate shape.

5. The device of claim 1, said non-skid end portion comprising a pivot pad rotatably connected to said shaft portion, said pivot pad having a flat bottom surface.

6. The device of claim 5, said pivot pad having a generally trapezoidal cross-section, a wide portion of said trapezoidal cross-section adjacent said flat bottom surface.

7. The device of claim 1, said shaft portion comprised of square steel tubing.

8. The device of claim 1, said bracket having a prong formed interior of said U-shaped configuration.

9. The device of claim 8, said prong extending upwardly from said shaft portion, said prong having a height less than a height of said bracket.

10. The device of claim 9, said bracket and said prong being coated with a rubberized material.

11. The device of claim 1, further comprising:

an alarm device mounted on said shaft portion, said alarm device responsive to shocks affecting the door handle, said alarm device having an audio output.

12. The device of claim 11, said alarm device having a sensitivity control, said sensitivity control for setting said alarm so as to be responsive to a given threshold of shock affecting said door handle.

13. A door locking device for portable use and ready installation on a door handle comprising:

a shaft portion;

a non-skid end portion mounted on a lower end of said shaft portion; and a door handle engaging bracket affixed to an end of said shaft portion opposite said end portion, said bracket having a generally U-shaped configuration, said bracket having a prong formed interior of said U-shaped configuration, said prong extending upwardly from said shaft portion, said shaft having a generally arcuate shape between said bracket and said end portion.

14. The device of claim 13, said non-skid end portion comprising a pivot pad rotatably connected to said shaft portion, said pivot pad having a flat bottom surface.

15. The device of claim 14, said pivot pad having a generally trapezoidal cross-section, a wide portion of said trapezoidal cross-section adjacent said flat bottom surface.

16. The device of claim 13, said shaft portion receiving an adjustable slide member therein, said slide member affixed to said end portion, said slide member movable so as to move said end portion relative to said shaft portion.

* * * * *